US010746194B2

(12) United States Patent
Munz

(10) Patent No.: US 10,746,194 B2
(45) Date of Patent: Aug. 18, 2020

(54) HOLDING SYSTEM FOR A FAN

(71) Applicant: EBM-PAPST MULFINGEN GMBH & CO. KG, Mulfingen (DE)

(72) Inventor: Martin Munz, Hollenbach (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 271 days.

(21) Appl. No.: 15/539,806

(22) PCT Filed: Jan. 25, 2016

(86) PCT No.: PCT/EP2016/051407
§ 371 (c)(1),
(2) Date: Nov. 1, 2017

(87) PCT Pub. No.: WO2016/120184
PCT Pub. Date: Aug. 4, 2016

(65) Prior Publication Data

US 2018/0058477 A1 Mar. 1, 2018

(30) Foreign Application Priority Data

Jan. 30, 2015 (DE) ..... 10 2015 201 704

(51) Int. Cl.
*F04D 29/64* (2006.01)
*F04D 29/70* (2006.01)
(Continued)

(52) U.S. Cl.
CPC ..... *F04D 29/646* (2013.01); *F04D 29/023* (2013.01); *F04D 29/668* (2013.01); *F04D 29/703* (2013.01)

(58) Field of Classification Search
CPC .... F04D 29/526; F04D 29/646; F04D 29/703; H02K 5/10; F24F 13/082; F24F 13/20; F24F 13/08
(Continued)

(56) References Cited

U.S. PATENT DOCUMENTS 2,100,994 A * 11/1937 Cohen ..... F04D 29/703 415/121.2
2,571,726 A * 10/1951 Koch ..... F24F 7/013 454/310
(Continued)

FOREIGN PATENT DOCUMENTS

DE 545112 C1 2/1932
DE 3813431 A1 11/1989
(Continued)

OTHER PUBLICATIONS

English Translation of EP1895166A1 (Year: 2008).*
(Continued)

*Primary Examiner* — Eldon T Brockman
*Assistant Examiner* — Wesley Le Fisher
(74) *Attorney, Agent, or Firm* — Tarolli, Sundheim, Covell & Tummino LLP

(57) ABSTRACT

The invention relates to a holding system for a fan comprising a wall ring and a protective grille. A holding system according to the invention for a fan with a protective grille having at least one protective-grille strut arranged in the circumferential direction and comprising a wall ring having a first end face is characterized in that the wall ring has at least one first connecting element on the first end face and the protective grille has at least one second connecting element, whereby the first connecting element can be operatively connected to the second connecting element, and the
(Continued)

Figure 1:
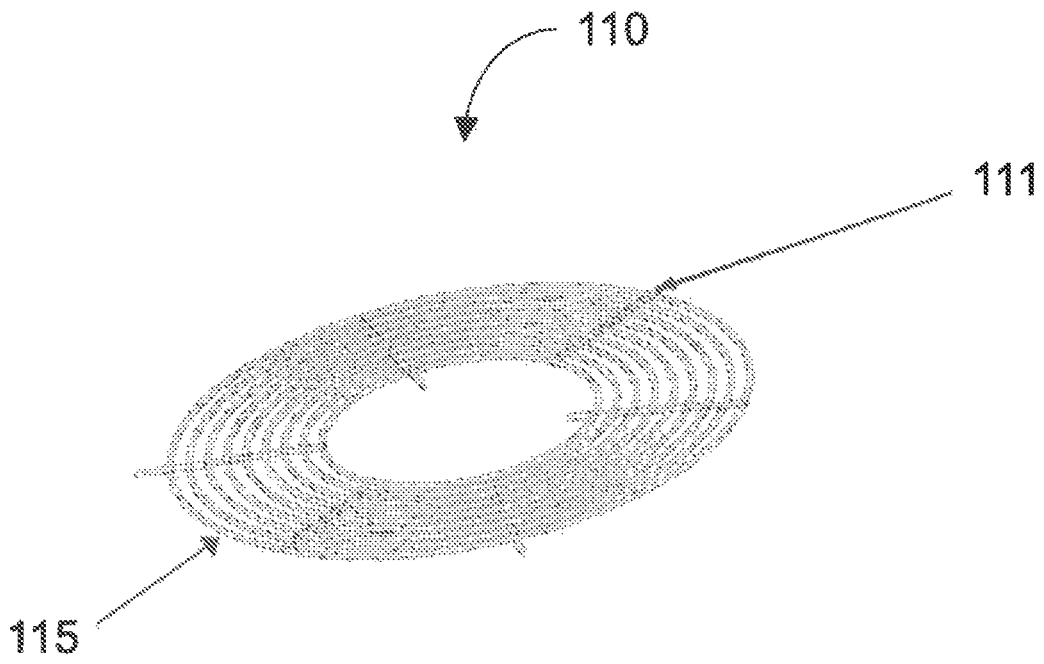

second connecting element is arranged so as to be sunk in the first end face of the wall ring.

7 Claims, 6 Drawing Sheets

(51) Int. Cl.
*F04D 29/02* (2006.01)
*F04D 29/66* (2006.01)

(58) Field of Classification Search
USPC ..... 416/247 R; 415/121.2; 361/678, 695
See application file for complete search history.

(56) References Cited

U.S. PATENT DOCUMENTS 3,402,882 A * 9/1968 Militello ..... F04D 29/703 415/121.2
3,963,382 A * 6/1976 Patton ..... F04D 29/646 417/361
4,353,680 A * 10/1982 Hiraoka ..... F04D 29/646 415/201
4,724,747 A 2/1988 Sturn et al.
4,779,518 A * 10/1988 Artwick ..... F24F 7/013 16/360
5,498,130 A * 3/1996 Wakley ..... B60H 1/00457 415/121.2
5,575,622 A 11/1996 Zimmerman et al.
6,036,444 A 3/2000 Barney et al.
6,439,852 B1 * 8/2002 Andriotis ..... F04D 29/703 415/121.2
7,140,837 B2 * 11/2006 Ku ..... F04D 29/526 415/121.2
7,530,783 B1 * 5/2009 Ediger ..... F04D 29/646 415/121.2
2007/0231142 A1 * 10/2007 Liu ..... F04D 29/023 416/189
2013/0045085 A1 * 2/2013 Frank ..... F04D 29/668 415/119
2013/0108439 A1 * 5/2013 Zhang ..... F04D 29/646 415/220
2015/0267716 A1 * 9/2015 Haaf ..... F24F 13/20 415/196

FOREIGN PATENT DOCUMENTS

DE 19536928 C1 1/1997
DE 102005028104 A1 12/2006
DE 10111397 B4 * 4/2010 ..... F04D 29/703
DE 202010010623 U1 12/2011
EP 1895166 A1 * 3/2008 ..... F04D 29/526
EP 1895166 A1 5/2008
FR 1401899 A 6/1965

OTHER PUBLICATIONS

English Translation of DE10111397B4 (Year: 2010).*
PCT/EP2016/051407 International Search Report, completed Apr. 20, 2016.
PCT/EP2016/051407 International Preliminary Report on Patentability, dated Aug. 1, 2017.

* cited by examiner

HOLDING SYSTEM FOR A FAN

CROSS REFERENCES TO RELATED APPLICATIONS

This application filed under 35 U.S.C § 371 is a national phase application of International Application Serial Number PCT/EP2016/051407 filed Jan. 30, 2016, which claims priority to German Application 10 2015 201 704.4. filed Jan. 30, 2015.

The invention relates to a holding system for a fan. The holding system has a wall ring and a protective grille.

Fans are installed, for example, in walls. For this purpose, a wall ring can be employed that is inserted into an appropriate wall penetration and that can have holding means for the fan. Moreover, the wall ring can fulfill other functions such as, for instance, it can convey the power supply line to the motor of the fan.

Conventional fans have rotors that generate an air flow during operation. Towards this end, the rotors have blades that rotate around a center axle. For safety reasons, the rotor has to be protected against being inadvertently touched. For this purpose, the state of the art discloses protective grilles that are connected to the wall ring and that form such a fine-meshed grille in front of the rotor that finger protection is ensured, that is to say, there is no opening through which a finger could fit and come into contact with the rotating blades.

The state of the art discloses two fundamental ways to connect the protective grille to the wall ring: on the one hand, the protective grille and the wall ring can be manufactured as a single piece, for example, in the form of an injection-molded part. An advantageous aspect in this context is that the protective grille does not have to be attached by means of a separate assembly step. A drawback here, however, is that the requisite injection mold is expensive. Another disadvantage is the fact that the protective grille cannot be removed without being destroyed in the process, so that, for instance, maintenance work can only be carried out from the side of the wall opposite from the protective grille. If maintenance work cannot be performed from this side, for example, because this side is not accessible to maintenance personnel or the maintenance has to be done from the other side, the entire fan along with its holding system have to be removed from the wall, which is very laborious. It is likewise disadvantageous that the manufacturing process involving plastic injection molding means that the protective grille also has to be made of plastic. For strength-related reasons, the protective grille in this case has to consist of relatively thick grille struts, as a result of which the cross section that is free for the air flow is inevitably reduced, thus diminishing the efficiency and detrimentally affecting the running performance.

On the other hand, the wall ring and the protective grille can comprise two separate components, whereby the protective grille has to be mounted onto the wall ring. Normally, the protective grille is joined to the wall ring by means of a non-positive screwed connection, whereby the screw head and any washers that might be present bring about a height increase, something which can be a drawback in tight installation conditions. Moreover, the assembly involves increased effort, whereby additional loose parts such as screws and conceivably washers, which also need to be included in the delivery, have to be installed and can easily be lost.

The objective of the invention is to put forward an inexpensive holding system with a wall ring and a protective grille whereby the wall ring and the protective grille can be taken apart without being destroyed in the process, while also being easy to install, and whereby the fact that the protective grille can be dismantled should not have a negative effect on the height of the holding system.

This objective is achieved according to the invention by means of a holding system according to claim 1.

A holding system according to the invention for a fan comprising a protective grille having at least one protective-grille strut arranged in the circumferential direction and comprising a wall ring having a first end face is characterized in that the wall ring has at least one first connecting element on the first end face and the protective grille has at least one second connecting element, whereby the first connecting element can be operatively connected to the second connecting element, and the second connecting element is arranged so as to be sunk in the first end face of the wall ring, and whereby the wall ring also has at least one motor-holding strut and said motor-holding strut has damping teeth with which the at least one protective-grille strut can intermesh.

Here, the first end face of the wall ring is the end face facing the protective grille. The protective grille is held on the wall ring by means of the operative connection between the first and the second connecting elements. The at least one protective-grille strut can be arranged essentially like a spiral between the axle of the fan and the wall ring as the outer delimitation. However, there can also be multiple protective-grille struts, whereby the multiple protective-grille struts can be arranged in concentric circles. In all of the cases, the at least one protective-grille strut can be configured so as to be round or in the form of a polygon. The cross section of the at least one protective-grille strut can also be configured so as to be round or in the form of a polygon, whereby the corners can also be designed so as to be rounded off.

Owing to the fact that the second connecting element is sunk into the end face of the wall ring, the attachment of the protective grille does not extend beyond the end-face contour of the wall ring.

The motor that drives the fan blades can be held in the wall ring by means of the motor-holding strut. It has proven to be particularly advantageous for the wall ring to have several, for instance, two or more, motor-holding struts. Thanks to the at least two motor-holding struts, the motor is held securely.

The motor-holding strut has damping teeth with which the at least one protective-grille strut can intermesh. This remedies the problem that an essentially flat protective grille is prone to a certain amount of oscillation or vibration. Owing to the damping teeth in the motor-holding strut, the at least one protective-grille strut can be accommodated in such a way as to rest against the damping teeth and the vibrations that occur during operation are effectively damped.

In an advantageous embodiment, the first connecting element has at least one flexible external undercut with an internal undercut, whereby the second connecting element can be snapped into the internal undercut. Due to the flexibility of the external undercut, the second connecting element can be snapped in behind the internal undercut and subsequently snapped out once again by bending the external undercut, as a result of which the protective grille can be disassembled without being destroyed. This snapping technique simplifies the assembly so that it can be easily carried out without a tool, thus minimizing the assembly work.

Moreover, flexible external undercuts can be manufactured cost-effectively during the production of the wall ring.

For example, a flexible external undercut can be shaped on in one work step during the production of the wall ring.

It has proven to be advantageous for the second connecting element to be arranged on a radial strut of the protective grille. The radial strut runs in the radial direction of the protective grille. In this context, the second connecting element can constitute an extension of the radial strut. The extension can continue in the radial direction or else it can be positioned on the radial strut by about 90° in the direction of the wall ring. Here, the extension of the radial strut can also be bent. However, the extension can also be installed initially as a separate component on the radial strut, for instance, it can be integrally bonded to it. As an initially separate component, however, the second connecting element can also be installed in any desired section of a protective-grille strut and does not have to constitute an extension of a radial strut. The protective grille is held on the wall ring by means of the second connecting element that is snapped behind the flexible external undercut. The radial strut can also have the function of holding the at least one protective-grille strut that runs in the circumferential direction. For this purpose, it can be operatively connected to the at least one protective-grille strut. For instance, the radial strut can be soldered or welded to the at least one protective-grille strut.

In an advantageous embodiment, the flexible external undercut is configured as a snap-type hook that acts in the circumferential direction. Here, a counter-bearing for the radial strut can be provided in the circumferential direction counter to the snap-type hook, so that the radial strut is held in the circumferential direction between the snap-type hook and the counter-bearing. By the same token, it is possible to structure the flexible external undercut using two snap-type hooks that are arranged offset to each other radially and in the circumferential direction, whereby the directions of action of the two snap-type hooks are oriented counter to each other in the circumferential direction. This arrangement makes it possible to reduce the size of the internal undercut of each snap-type hook, thereby minimizing the bending of the snap-type hooks during the assembly or disassembly of the radial strut. This reduces the amount of force that has to be applied during the assembly or disassembly, thus serving to further simplify the assembly or disassembly.

As an alternative to the configuration of the flexible external undercut in the form of a snap-type hook that acts in the circumferential direction, the flexible external undercut can also be configured in the form of a hook that acts in the radial direction.

In another alternative embodiment, the flexible external undercut can be configured as a cylindrical snap-type hook. Such a cylindrical snap-type hook can be configured, for example, as a hole, whereby the flexible external undercut can be formed with a corresponding appropriate shoulder, for example, by means of the injection-molding process with a stamp. In this case, the flexibility can be attained through the material properties of the wall ring.

In another advantageous embodiment, the first connecting element is configured as a cylindrical hole, whereby the second connecting element has a flexible external undercut. For instance, the second connecting element can be in the form of a plug, whereby the flexibility constitutes a property of the plug that is inserted into the through hole so far that an internal undercut, for example, in the form of a hook, snaps behind the thickened wall of the through hole. A flexible arm can serve as such a hook and it then comes to rest against the plug when inserted through the through hole and it subsequently springs back open behind the through hole. In another embodiment, the plug itself can have a hollow space so that the plug wall can be pressed into the hollow space at the section where an internal undercut is present at least in certain segments as an enlargement of the diameter, subsequently springing back open as soon as the section with the diameter enlargement has been pressed through the through hole. An attachment by means of a press-stud construction is also conceivable.

It has proven to be advantageous for the wall ring to have at least three first connecting elements distributed over the circumference and for the protective grille to have at least three second connecting elements that can be operatively connected to the first connecting element and that are distributed over the circumference in the same manner. This allows a three-point attachment of the protective grille to the wall ring, which enhances the stability of the attachment.

In an advantageous embodiment, the wall ring can be made of a plastic material. For instance, the wall ring can be made of a thermoplastic by means of the injection-molding process, which translates into an especially simple and cost-effective production of the wall ring, even if, for example, the first end face has a complex geometry.

In another advantageous embodiment, the protective grille is made of a metal material. As an alternative, the protective grille can likewise be made of a plastic material, for example, a thermoplastic, by means of the injection-molding process.

In one embodiment, the protective grille is configured to be flat, so that, in its assembled state, it does not protrude in the axial direction beyond the contour of the first end face of the wall ring.

In another advantageous embodiment, the protective grille is configured axially in the direction of the wall ring, that is to say, configured with a convex shape in the direction of the fan installed in the wall ring. Owing to this configuration, the protective grille is pre-tensioned and, in its assembled state, it intermeshes with the damping teeth of the motor-holding strut and does not protrude in the axial direction beyond the contour of the first end face of the wall ring.

Additional advantages, special features and practical refinements of the invention ensue from the subordinate claims and from the presentation below of preferred embodiments with reference to the figures.

Figure 2:
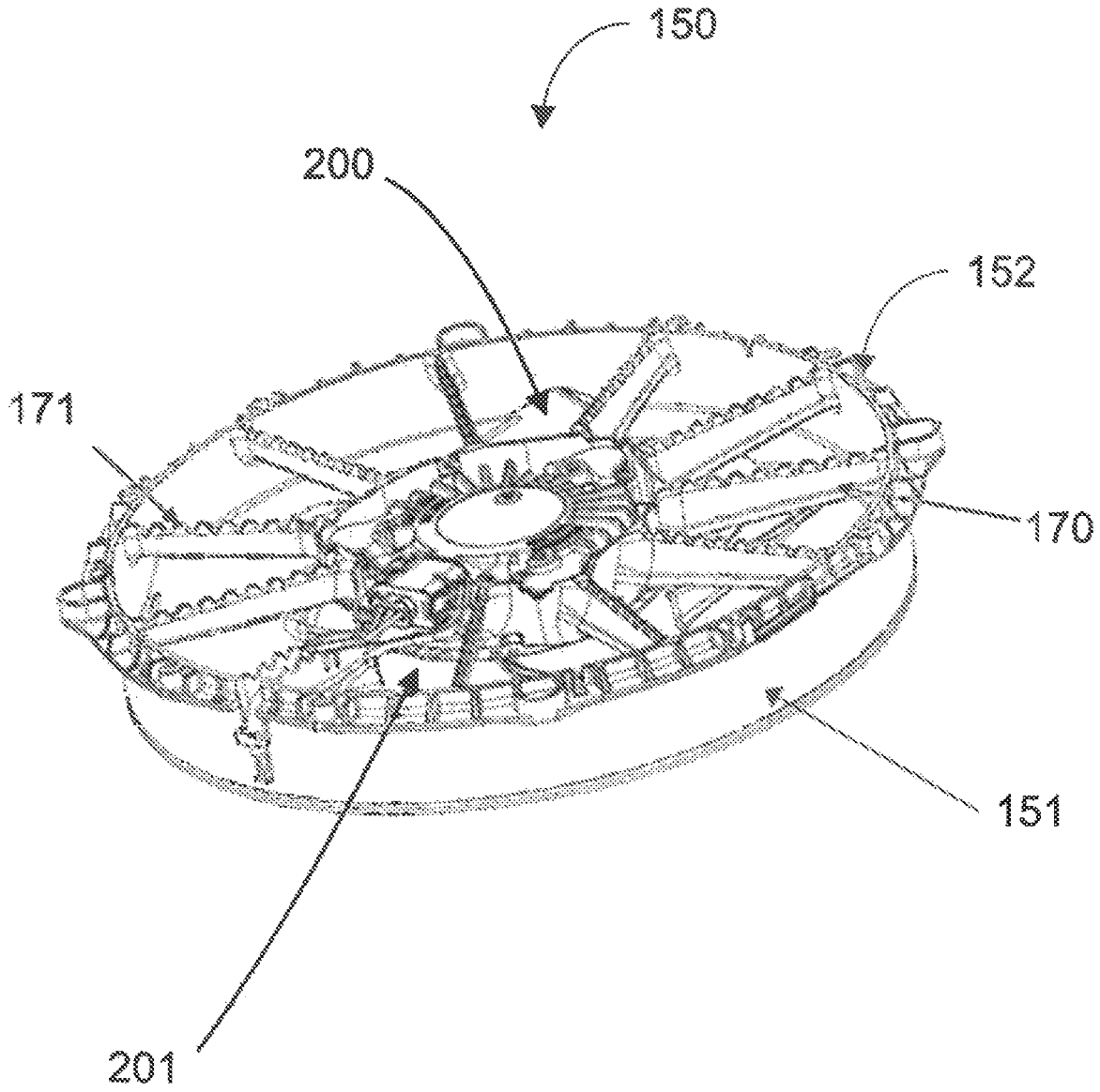
Figure 3:
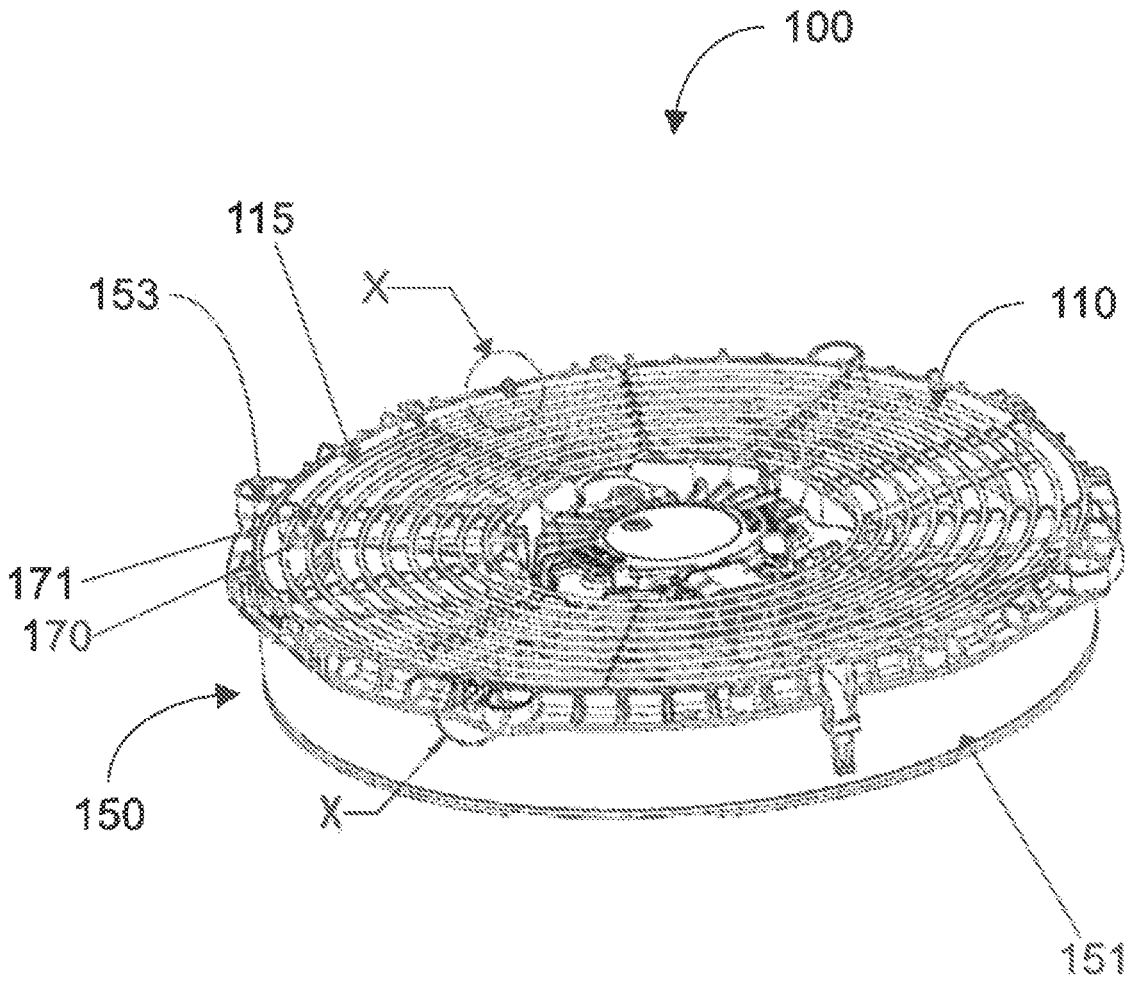
Figure 4:
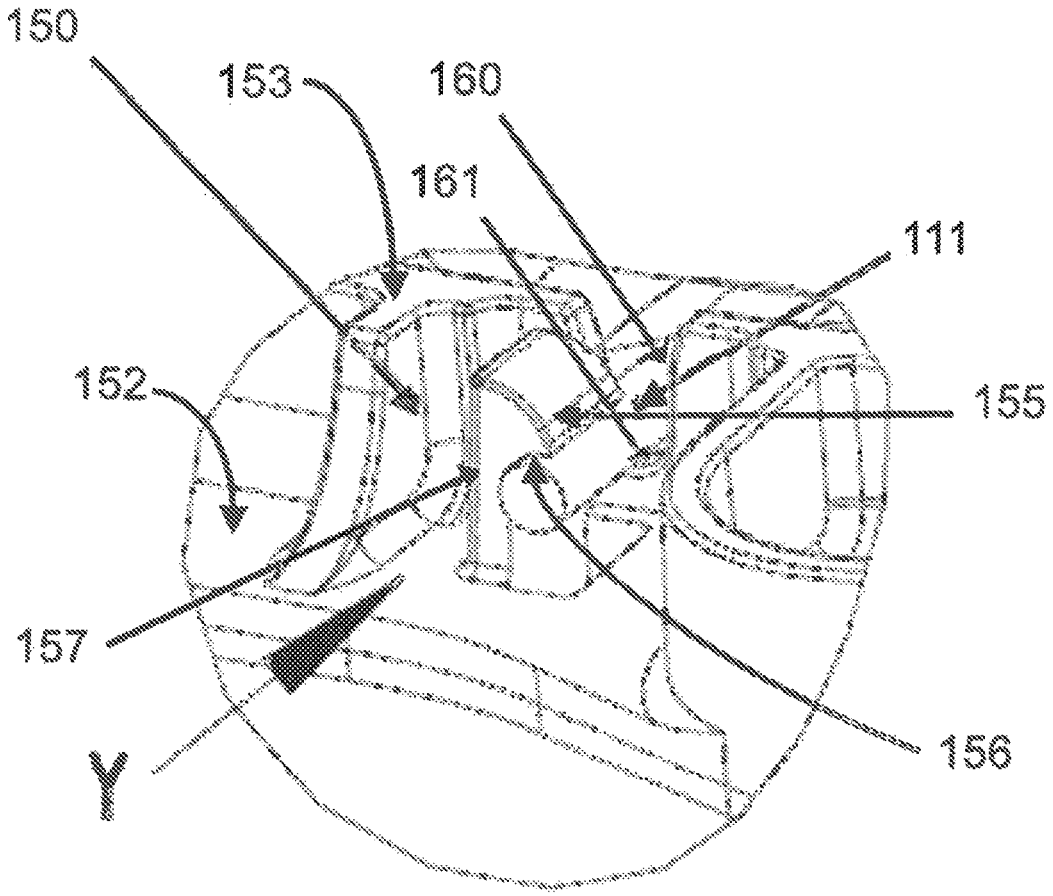
Figure 5:
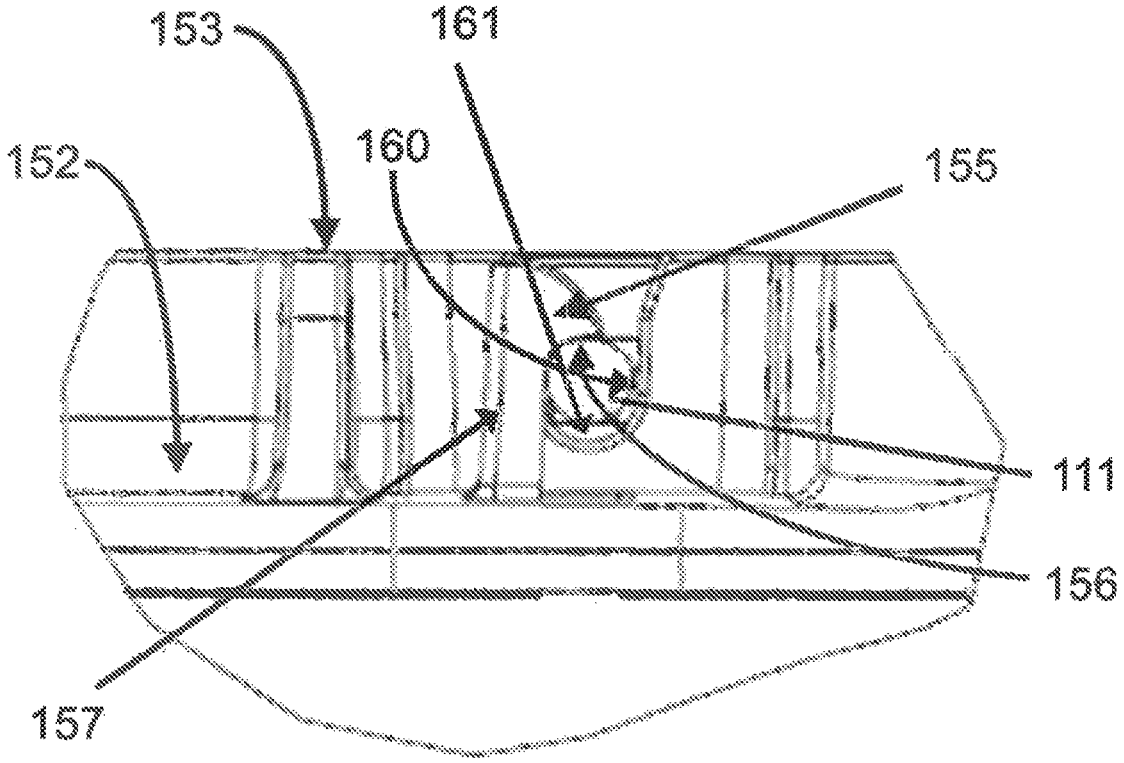
Figure 6:
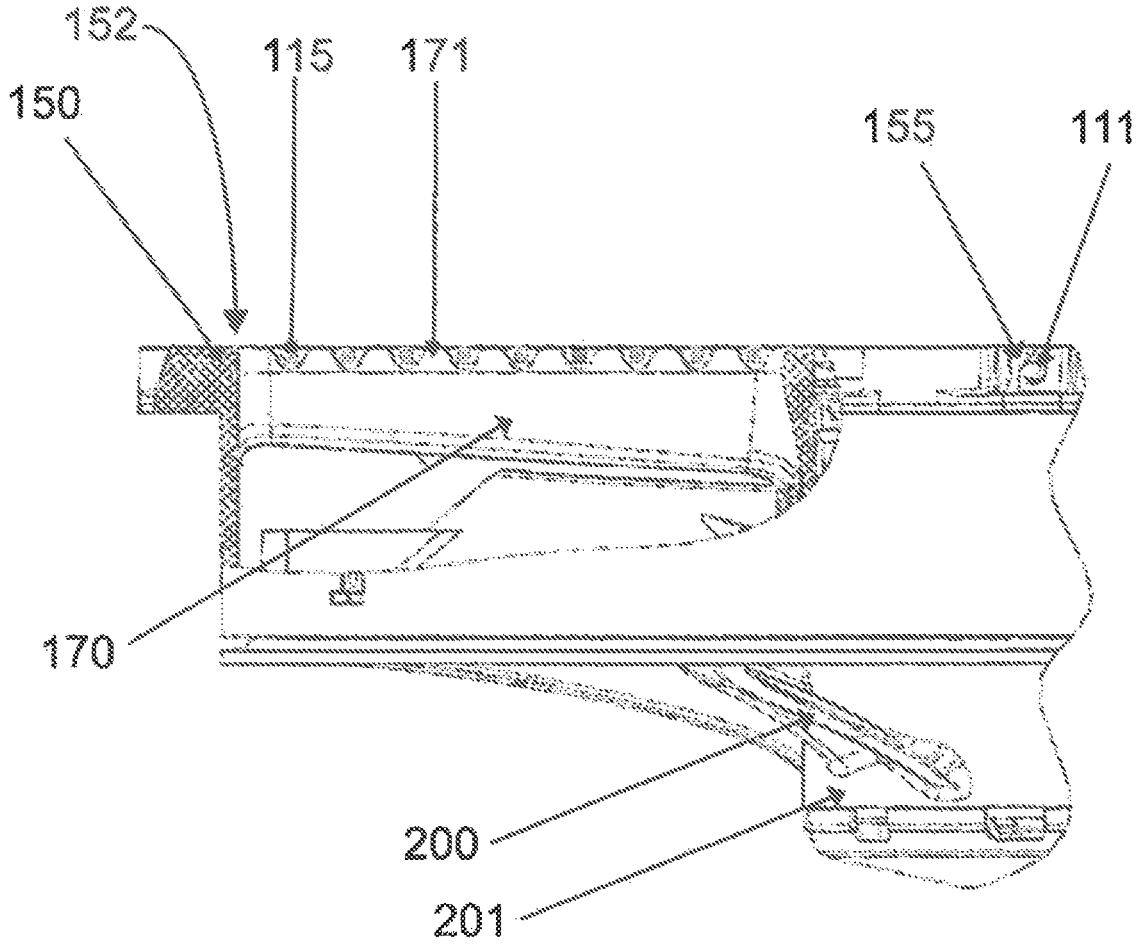

The figures show the following:

FIG. 1 a protective grille according to the invention, in a three-dimensional view;

FIG. 2 a wall ring according to the invention, in a three-dimensional view;

FIG. 3 a holding system according to the invention, in a three-dimensional view;

FIG. 4 a detail X of the holding system according to the invention from FIG. 3, in a three-dimensional view;

FIG. 5 a detail X of the holding system according to the invention from FIG. 4, in a side view as seen from direction Y of FIG. 4;

FIG. 6 a holding system according to the invention, in a partial sectional view.

FIG. 1 shows a protective grille 110 according to the invention, in a three-dimensional view. The protective grille 110 has nine protective-grille struts 115, which are arranged as concentric rings. The protective-grille struts 115 are intersected by six radial struts 111 that run in the radial direction, whereby the protective-grille struts 115 and the radial struts 111 are joined to each other at their intersections. Three of the six radial struts 111 extend in the radial direction beyond the outer protective-grille strut 115, whereas the three remaining radial struts 111 end at the outer protective-grille strut 115. Each extended radial strut 115 alternates with a radial strut 115 that ends at the outer protective-grille strut 115.

FIG. 2 shows a wall ring 150 according to the invention, in a three-dimensional view. The wall ring 150 has a circumferential surface 151 and a first end face 152. A fan fitted with blades 200 and with a hub 201 is accommodated in the wall ring 150. The wall ring 150 has eleven motor-holding struts 170 that hold the motor of the fan and thus the fan itself in the wall ring 150. The motor-holding struts 170 have damping teeth 171.

FIG. 3 shows a holding system 100 according to the invention, in a three-dimensional view. The holding system 100 has a protective grille 110 and a wall ring 150. The protective grille is clipped in place behind flexible external undercuts 155 with the radial struts 111 that protrude beyond the outer protective-grille strut 115 (not visible in the figure). The protective-grille struts 115 are situated in damping teeth of the motor-holding struts 170, whereby the protective grille 110 does not protrude beyond the end face contour 153 of the wall ring 150.

FIG. 4 shows a detail X of the holding system 100 according to the invention from FIG. 3, in a three-dimensional view. The wall ring 150 has a flexible external undercut 155 in the form of a snap-type hook that acts in the circumferential direction. A radial strut 111 that protrudes beyond the outer protective-grille strut 115 is clipped in place behind the flexible external undercut 155. In this context, the radial strut 111 that protrudes beyond the outer protective-grille strut 115 is held in the circumferential direction, on the one hand, by the arm 157 of the snap-type hook 155, and, on the other hand, by a counter-bearing 160 that is shaped onto the wall ring 150. In the axial direction, the radial strut 111 that protrudes beyond the outer protective grille 115 is held by the internal undercut 156 of the snap-type hook 155, whereby the radial strut 111 that protrudes beyond the outer protective grille 115 in the opposite direction is held by a counter-bearing 161 of the wall ring 150.

FIG. 5 shows a detail X of the holding system 100 according to the invention from FIG. 4, in a side view as seen from direction Y in FIG. 4. This view clearly shows how the radial strut 111 that protrudes beyond the outer protective grille 115 is held, on the one hand, by the arm 157 of the snap-type hook 155 and, on the other hand, by a counter-bearing 161 that is shaped onto the wall ring 150, and it is held in the axial direction, on the one hand, by the internal undercut 156 of the snap-type hook 155 and, on the other hand, by the counter-bearing 161.

FIG. 6 shows a holding system 100 according to the invention, in a partial sectional view. This figure very clearly shows how the protective-grille strut 115 intermeshes with the damping teeth 171 of the motor-holding strut 170, as a result of which it is held by the wall ring 150 without oscillations or vibrations. Owing to a configuration of the protective grille 110 in such a manner that the protective grille 110 in its non-assembled state is convex in the direction of the wall ring, that is to say, in the assembled state, it is pre-curved in the direction of the fan, the protective-grille struts 115 are pressed into the damping teeth 171 during the assembly. On the other hand, the radial struts 111 tensioned in this manner exert a force onto the internal undercut 156 of the snap-type hook 155 in such a way that the protective grille is held in the wall ring 150 without oscillations or vibrations.

The embodiments shown here constitute only examples of the present invention and consequently must not be construed in a limiting manner. Alternative embodiments considered by the person skilled in the art are likewise encompassed by the scope of protection of the present invention.

LIST OF REFERENCE NUMERALS

100 holding system
110 protective grille
111 second connecting element
115 protective-grille strut
150 wall ring
151 circumferential surface
152 first end face
153 contour of the first end face
155 first connecting element, flexible external undercut, snap-type hook
156 internal undercut
157 arm of the snap-type hook
160 counter-bearing
161 counter-bearing
170 motor-holding strut
171 damping teeth
200 fan blade
201 fan hub

The invention claimed is:

1. A holding system for a fan comprising a protective grille having at least one protective-grille strut arranged in a circumferential direction and comprising a wall ring having a first end face, wherein the wall ring has at least one first connecting element on the first end face and the protective grille has at least one second connecting element, whereby the first connecting element can be operatively connected to the second connecting element, and the second connecting element is arranged so as to be sunk in the first end face of the wall ring, whereby the wall ring also has at least one motor-holding strut and said motor-holding strut has damping teeth with which the at least one protective-grille strut can intermesh, said first connecting element having at least one flexible external undercut with an internal undercut, whereby the second connecting element can be clicked into the internal undercut and said flexible external undercut is configured as a snap-type hook that acts in the circumferential direction.

2. The holding system according to claim 1, wherein the second connecting element is arranged on a radial strut of the protective grille.

3. The holding system according to claim 1, wherein the wall ring has at least three first connecting elements distributed over a circumference of the wall ring and the protective grille has at least three second connecting elements that can be operatively connected to the first connecting elements and that are distributed over a circumference of the protective grille in the same manner.

4. The holding system according to claim 1, wherein the wall ring is made of a plastic material.

5. The holding system according to claim 1, wherein the protective grille is made of a metal material.

6. The holding system according to claim 1, wherein the protective grille is configured to be flat and, in an assembled state, does not protrude in an axial direction beyond a contour of the first end face of the wall ring.

7. The holding system according to claim 1, wherein the protective grille is configured with a convex shape axially in a direction of the wall ring and, in an assembled state does not protrude in an axial direction beyond a contour of the first end face of the wall ring.

* * * * *